US006851186B2

(12) United States Patent
Liang

(10) Patent No.: US 6,851,186 B2
(45) Date of Patent: Feb. 8, 2005

(54) ENVIRONMENTAL PROTECTION CONCERNED METHOD FOR MANUFACTURING HEAT SINK

(75) Inventor: Robert Liang, Yang Mei (TW)

(73) Assignee: Malico, Inc. (TW)

( * ) Notice: Subject to any disclaimer, the term of this patent is extended or adjusted under 35 U.S.C. 154(b) by 123 days.

(21) Appl. No.: 10/294,517

(22) Filed: Nov. 13, 2002

(65) Prior Publication Data

US 2004/0088860 A1 May 13, 2004

(51) Int. Cl.[7] ..... B23P 15/26
(52) U.S. Cl. ..... 29/890.03; 29/557; 29/505
(58) Field of Search ..... 29/890.03, 557, 29/505; 72/258; 165/80.3, 1.85

(56) References Cited

U.S. PATENT DOCUMENTS 6,032,362 A * 3/2000 Okikawa et al. ..... 29/890.03
6,088,917 A * 7/2000 Lee et al. ..... 29/890.03
6,134,783 A * 10/2000 Bargman ..... 29/890.03
6,202,303 B1 * 3/2001 Trobough ..... 29/890.03
6,367,152 B1 4/2002 Kataoka

* cited by examiner

*Primary Examiner*—Irene Cuda Rosenbaum

(57) ABSTRACT

An environment protection concerned method for manufacturing a heat sink includes the steps of: (a) putting a main material with a top into a die; (b) placing a heat transfer promoting material on the top of the main material, wherein the heat transfer promoting material has a thermal conductivity larger than that of the main material; and (c) forging the heat transfer promoting material and the main material to form a heat sink having a plurality of radiation fins.

6 Claims, 10 Drawing Sheets

ENVIRONMENTAL PROTECTION CONCERNED METHOD FOR MANUFACTURING HEAT SINK

FIELD OF THE INVENTION

The present invention is related to an environmental protection concerned method for manufacturing a heat sink, and more particularly for manufacturing a heat sink with a plurality of radiation fins.

BACKGROUND OF THE INVENTION

One kind of conventional heat sink currently used for heat dissipation in electronic components includes a plurality of radiation fins, and a base plate several times as large as the upper surface of the package of the electronic component (e.g., a CPU). Typically, the central portion of the base plate of the heat sink is made of a metal material having a larger thermal conductivity than the main material of the heat sink. However, there is a need for a heat sink having further enhanced heat dissipation capabilities for electronic components like the CPU of a personal computer or a large-scaled integrated circuit in order to cope with the trend of increasing heat generation of such electronic components due to the requirement for an even higher processing speed of a personal computer or a much more compact size of a IC component. For example, the increasing of the clock frequency and the number of gates will surely increase the heat generations of the electronic components.

An improved method for manufacturing the above-mentioned heat sink to enhance the heat dissipation was proposed by Kataoka (U.S. Pat. No. 6,367,152 B1).

In Kataoka's method, a metal material with larger thermal conductivity is joining integrally with the main material of the heat sink as a workpiece, and then forging the workpiece into a heat sink without the drawbacks of either the loss in heat transfer caused by the deformation of the metal plate or the deformation of the radiation fins caused by pretreatment when joining the metal plate to the base plate of the heat sink by screwing or brazing respectively. Kataoka's method includes the following steps: 1. nickel or tin plating on one surface or both surfaces of the two raw materials (for example: copper and aluminum); 2. brazing or soldering to join the two raw materials together into a workpiece; 3. putting the workpiece into the die; 4. forging the workpiece under the pressure to form a heat sink.

Please refer to FIGS. 1(*a*), 1(*b*), 2(*a*), and 2(*b*). FIGS. 1(*a*) and 1(*b*) are schematic diagrams showing a main material 1 and a heat transfer promoting material 2 with a higher thermal conductivity than the main material 1. As shown, the main material 1 and heat transfer promoting material 2 are joined integrally through nickel or tin plating and brazing to form a prior art workpiece 10. FIGS. 2(*a*) and 2(*b*) are schematic diagrams showing the workpiece 10 forged in a die 3 under pressure to form a semi-product of the prior art heat sink 4.

A problem with the prior art method is that, during the nickel plating process, heavy metal is released that can cause serious water pollution, or if tin plating is used, lead or zinc particles contained in the plating material are released into the air, which is harmful to the health of the workers during soldering process or anyone who is in the working area. Accordingly, the prior art method is a source of pollution and surely will cause the environmental protection concerns. Besides, the temperature of brazing is around 400° C., and there will be heavy metal particles contained in the brazing material that are released into the air, which is also harmful to the health of the workers of the brazing process or anyone who is in the working area. This is an even more hazardous source of environmental pollution. There are still other drawbacks like the high temperature of brazing will hurt the anodized surface formed during the plating process so as to hamper the quality of brazing, and will reduce the metal stress of the heat sink which will cause bending of the radiation fins while assembling with other parts (e.g., mounting on an IC package).

With the drawbacks of the prior art (discussed above) in mind, the applicant employed experiments and research full-heartily and persistently in an attempt to conceive an environmental protection concerned method for manufacturing heat sinks. The proposed method will not only solve the lead, zinc and heavy metal pollution problems but also decrease the manufacturing costs and improving the quality of the heat sinks.

SUMMARY OF THE INVENTION

It is therefore an object of the present invention to propose an environmental protection concerned method for manufacturing a heat sink with a plurality of radiation fins.

According to the aspect of the present invention, the method for manufacturing a heat sink includes the steps of: (a) putting a main material with a top into a die; (b) placing a heat transfer promoting material on the top of the main material, wherein the heat transfer promoting material has a thermal conductivity larger than that of the main material; and (c) forging the heat transfer promoting material and the main material to form a heat sink having a plurality of radiation fins.

According to an aspect of the invention, the main material has a plurality of positioners confining thereamong said heat transfer promoting material.

According to an embodiment of the invention, the positioners have a shape selected from a group consisting of walls, ribs, poles, pins, dowels, stops, and any combination thereof.

According to another aspect of the invention, the positioners are part of the main material.

According to another embodiment of the invention, the heat transfer promoting material, the main material, and the positioners are manufactured into a desired shape by a process selected from a group consisting of pressing, extruding, die-casting, powder-forming, machining and any combination thereof.

According to another embodiment of the invention, the main material is larger than the heat transfer promoting material.

According to yet another embodiment of the invention, the step (b) of the proposed method further includes the steps of: (b1) overflowing a material of the main material to bind together with the heat transfer promoting material after being pushed under pressure; (b2) projecting the radiation fins from the main material through a plurality of holes of the die; (b3) causing the heat transfer promoting material to form the central part of the top surface of the heat sink and the main material to form the surrounding part of the top surface of the heat sink; (b4) removing the heat sink from the die; and (b5) cutting and grinding the top surface of the heat sink into the base plate of the heat sink.

DETAILED DESCRIPTION OF THE PREFERRED EMBODIMENT

Figure 1B:
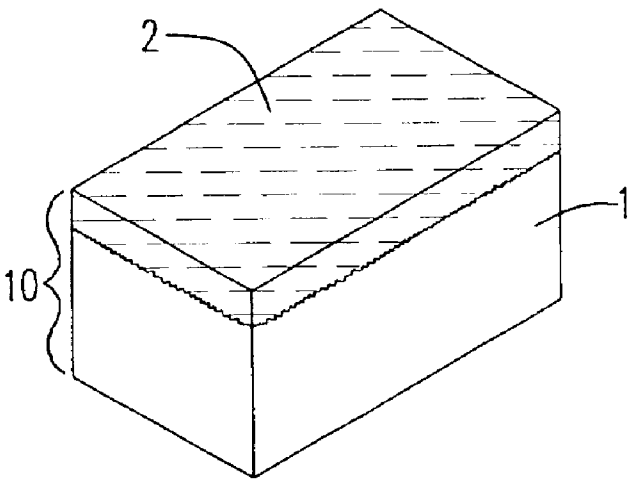
Fig. 1b (PRIOR ART)
FIG. 1(*a*) and FIG. 1(*b*) are schematic diagrams showing the workpiece of the prior art of the present invention.
Figure 1A:
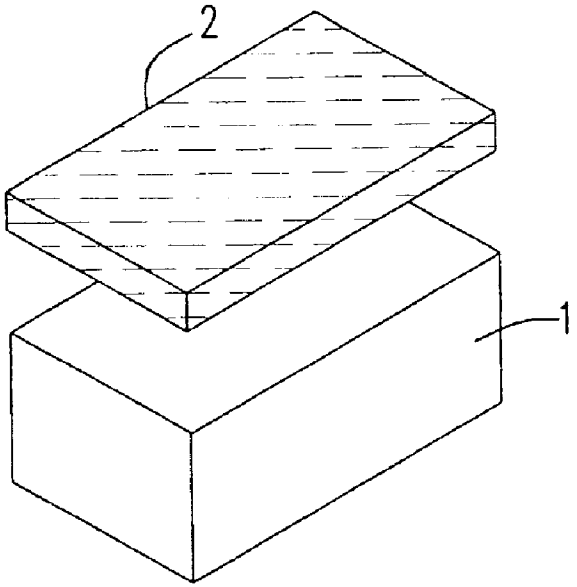
Fig. 1a (PRIOR ART)
Figure 2A:
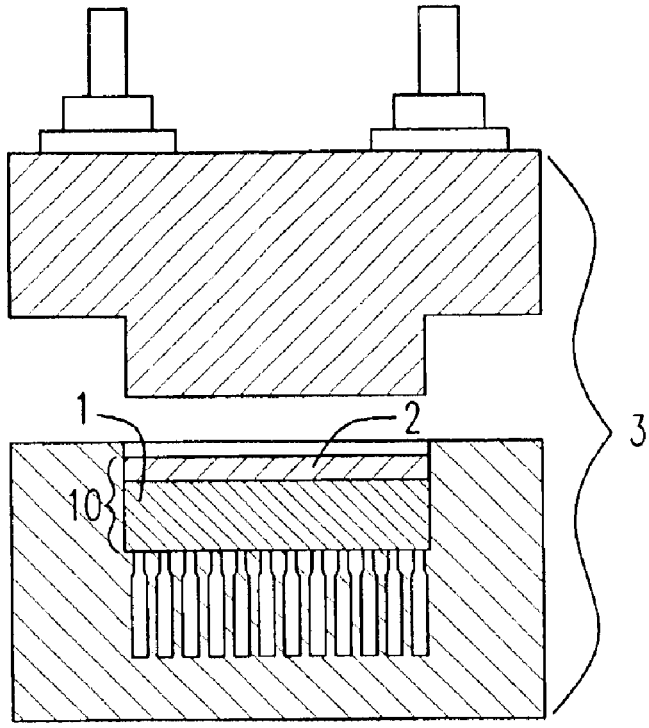
Fig. 2a(PRIOR ART)
FIGS. 2(*a*) and 2(*b*) are schematic diagrams showing the workpiece forging in a die under pressure to form a heat sink of the prior art of the present invention.
Figure 2B:
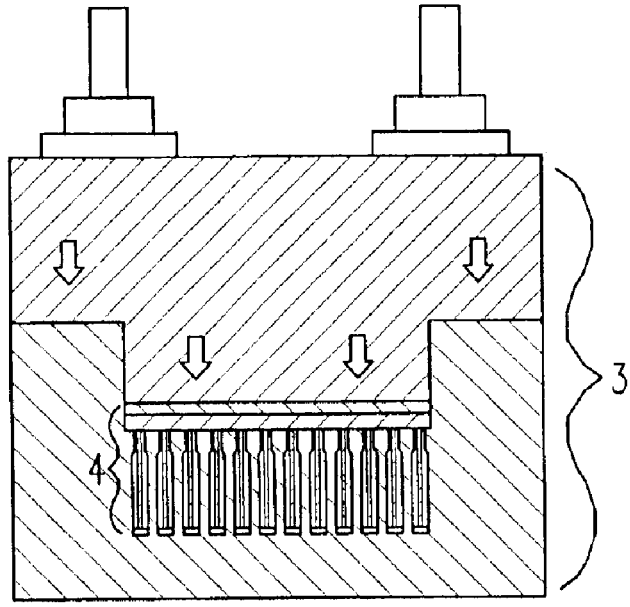
Fig. 2b(PRIOR ART)
Figure 3B:
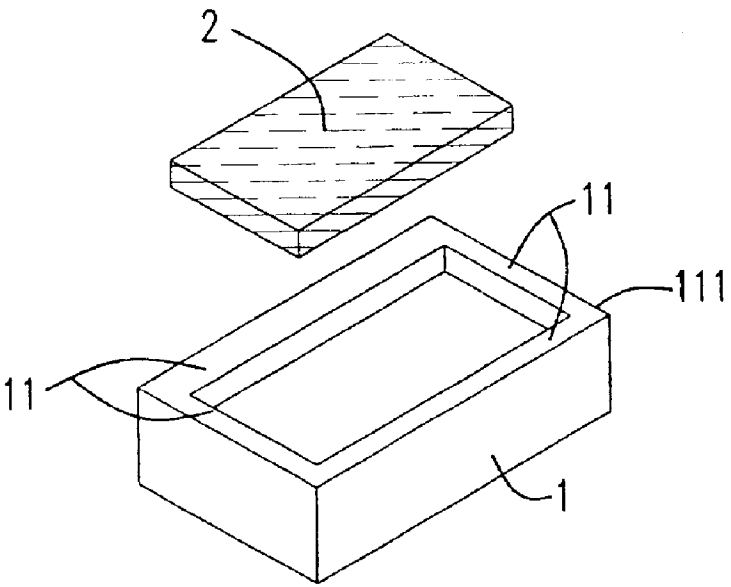
FIG. 3(*a*), FIG. 3(*b*), FIG. 3(*c*), FIG. 3(*d*), FIG. 3(*e*) and FIG. 3(*f*) are schematic diagrams showing the main material with different shapes of poisitioners and the heat transfer promoting material.
Figure 3A:
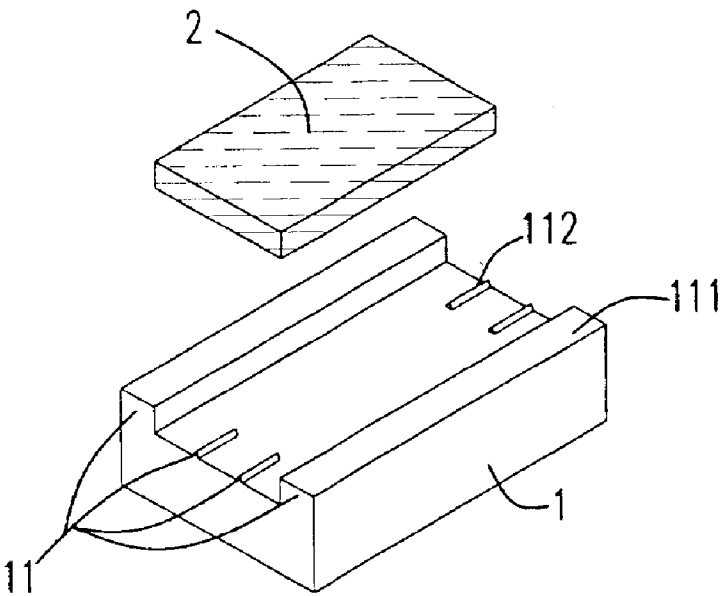
Figure 3D:
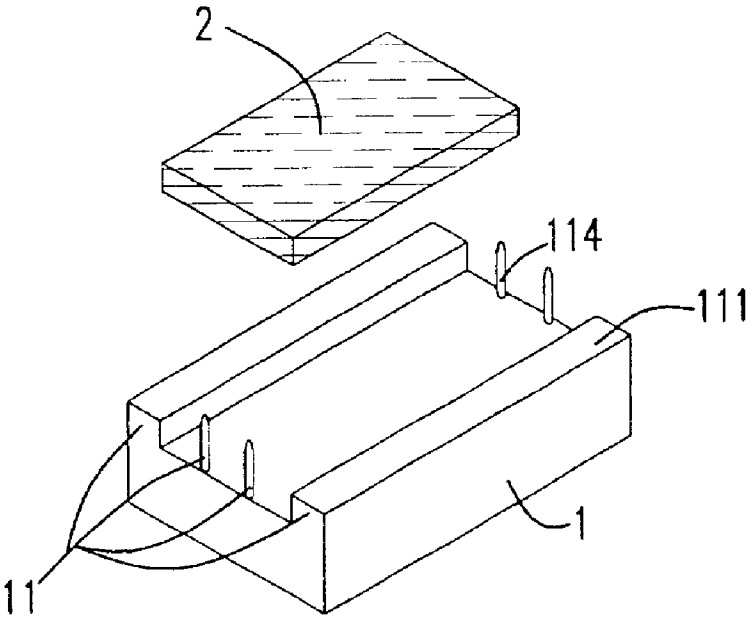
Figure 3C:
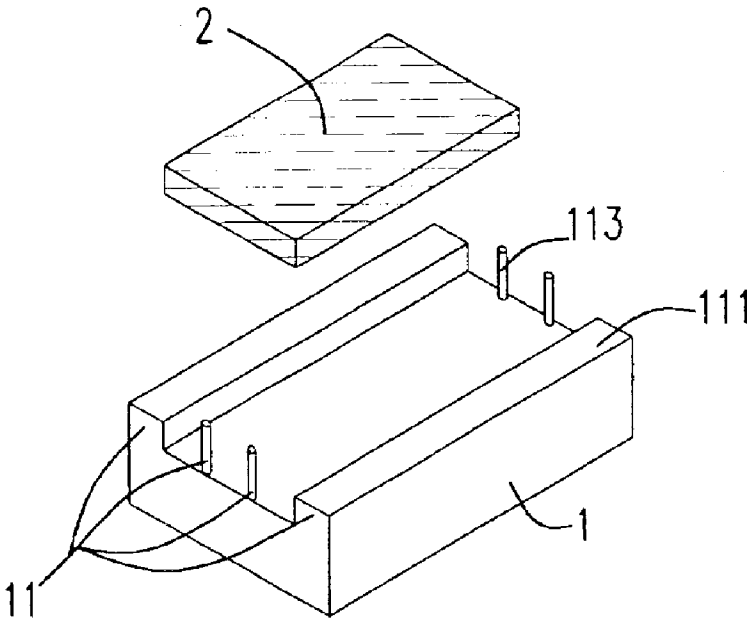
Figure 3F:
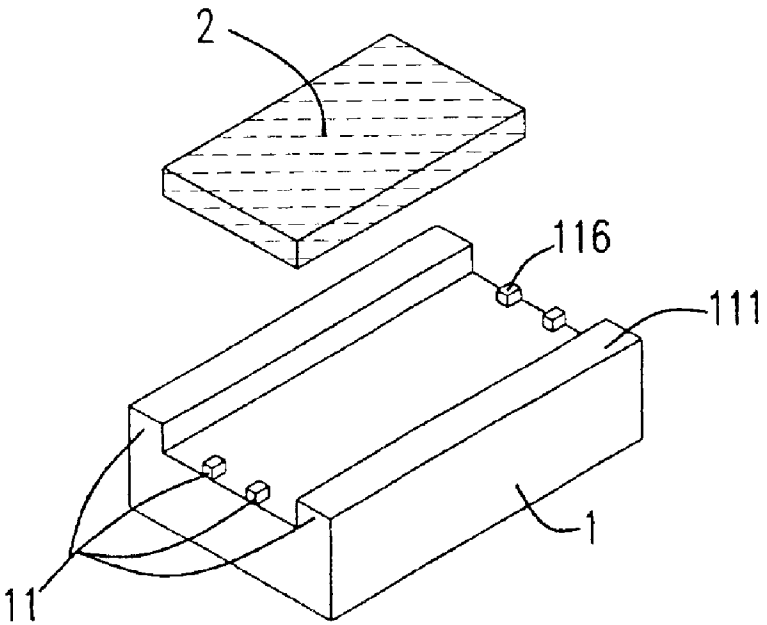
Figure 3E:
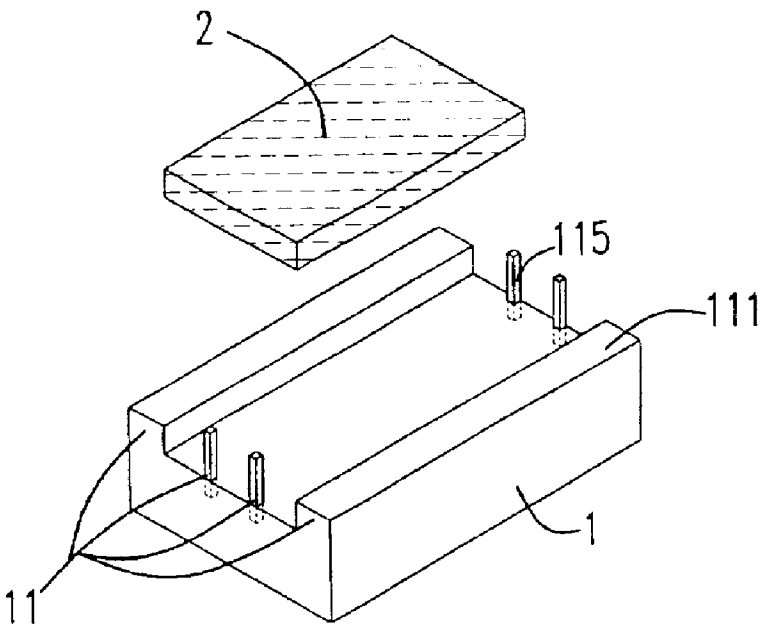

Please refer to FIGS. 3(*a*) to 3(*f*), which are schematic diagrams showing six preferred embodiments of the main material 1 and the heat transfer promoting material 2 before these parts are put into a die for manufacturing the heat sinks. In FIGS. 3(*a*) to 3(*f*), a positioner 11 is in a shape selected from a group of walls 111, ribs 112, poles 113, pins 114, dowels 115, stops 116 and any combination thereof. Each positioner 11 is on the top surface of the main material 1 and is part of the main material 1. A main material 1 is preferably larger than a heat transfer promoting material 2. The heat transfer promoting material 2 (for example: copper) has higher heat transfer conductivity than the main material 1 (for example: aluminum).

Figure 4:
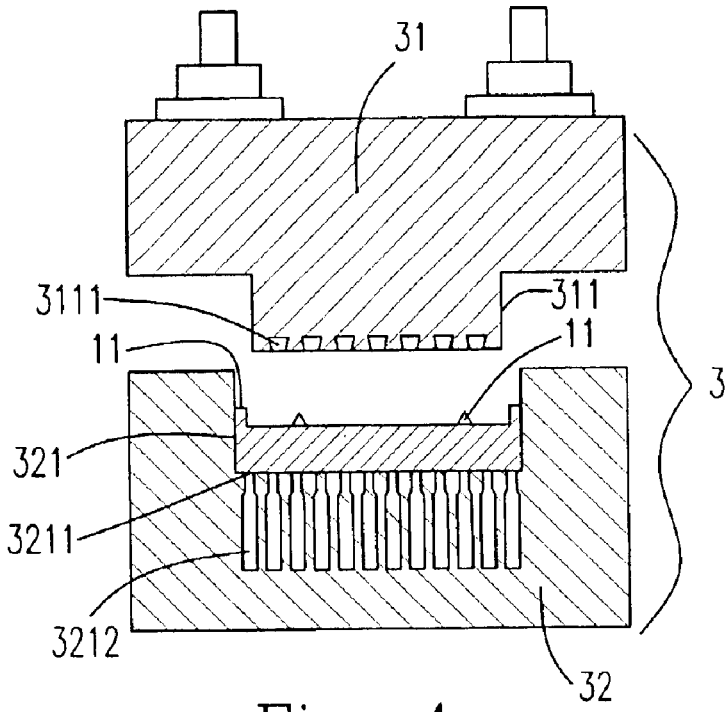
FIG. 4 is a schematic diagram showing the main material with a top is putting into the die.

Please refer to FIG. 4, which is a schematic diagram showing a main material 1 with positioners 111 putt into a die 3, where the force die part 31 used to press the main material 1 and the heat transfer promoting material 2 has a pushing head 311 with a plurality of grooves 3111 in dove-tail shapes, and the forming die part 32 of the die 3 has a receiving recess 321 where the main material 1 is received. The receiving recess 321 has a bottom surface 3211 with a plurality of holes 3212 for projecting the radiation fins of the heat sinks.

Figure 5:
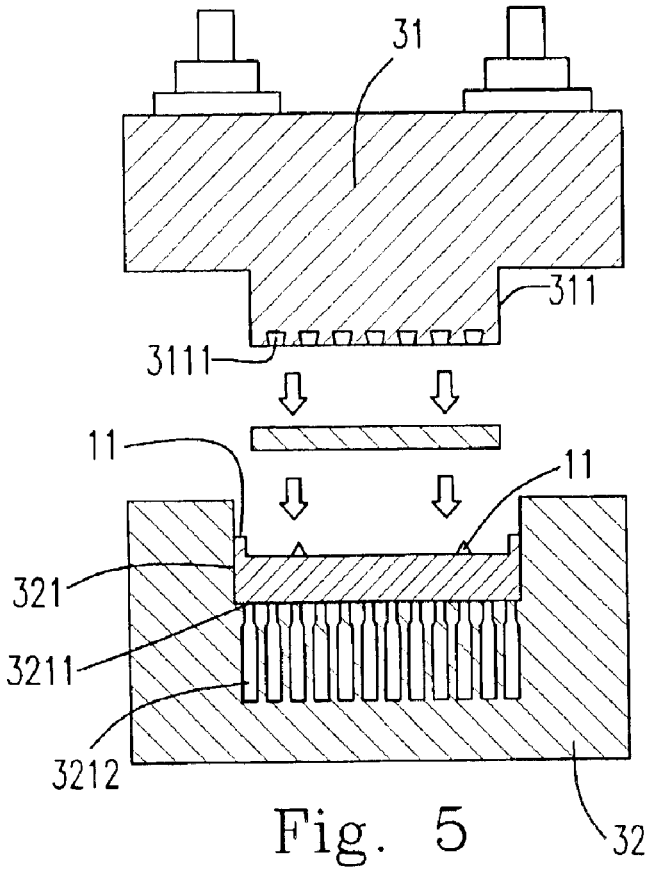
FIG. 5 is a schematic diagram showing the heat transfer promoting material is placing into the die on the top of the main material among positioners.

Please refer to FIG. 5, which is a schematic diagram showing the heat transfer promoting material 2 placed into the die on the top of the main material 1 among positioners 11.

Figure 6A:
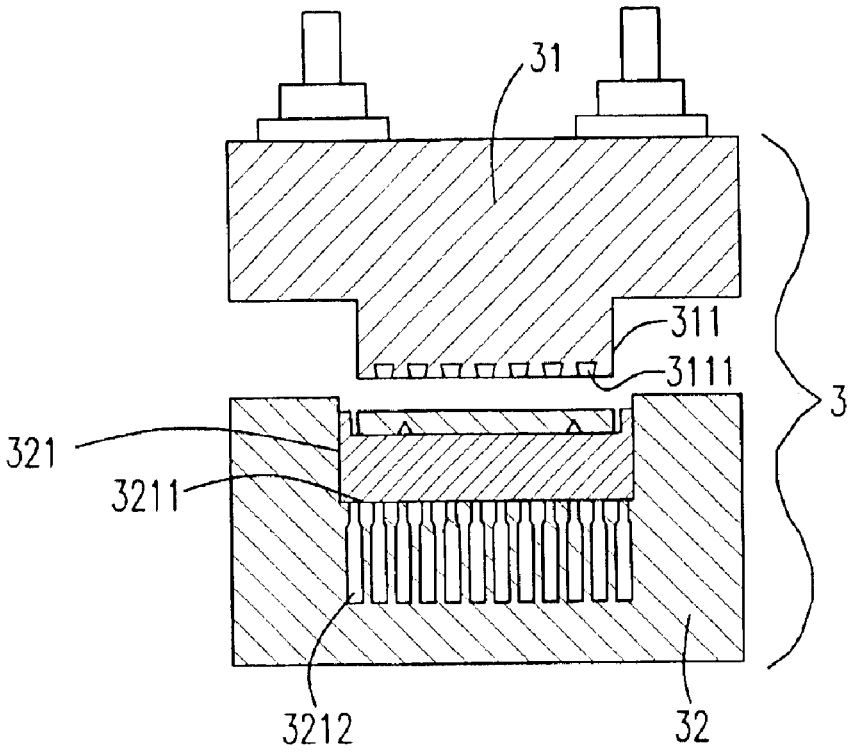
FIG. 6(*a*) and FIG. 6(*b*) are schematic diagrams showing the heat transfer promoting material and main material are pushing under pressure to form a heat sink.
Figure 6B:
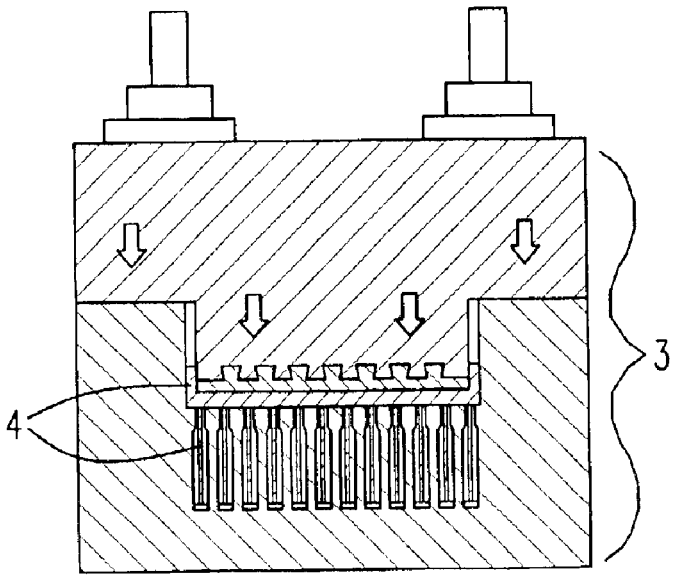

Please refer to FIGS. 6(*a*) and 6(*b*), which are schematic diagrams showing the heat transfer promoting material 2 and main material 1 pushed under pressure (pressed) to form a semi-product of heat sink 4. The size of the pushing head 311 of the upper part 31 of the die 3 is smaller than the main material 1. Firstly, when the heat transfer promoting material 2 and main material 1 are pushed under pressure to form a semi-product of the heat sink 4, the main material 1 will overflow and bind with the heat transfer promoting material 2 intimately due to the tremendous pressure upon the main material 1 and heat transfer promoting material 2 in the forming die part 32. Secondly, the heat transfer promoting material 2 will gap-fill into the dove-tail shaped grooves 3111. Thirdly, the main material 1 will be projected to form the radiation fins 41 of the semi-product of the heat sink 4 through the plurality of holes 3212 of the forming die part 32.

Figure 7:
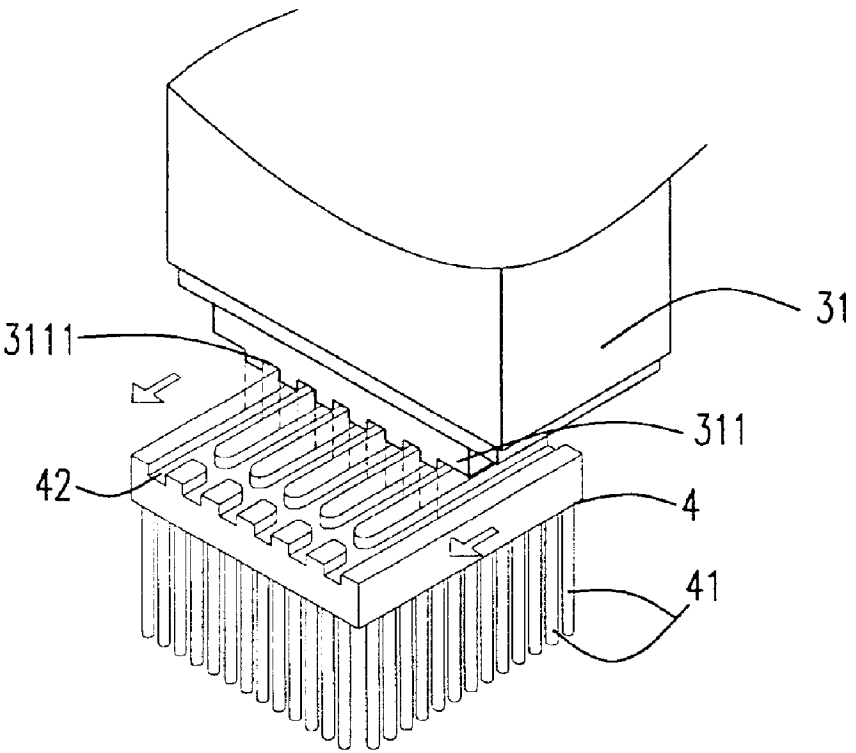
FIG. 7 is a schematic diagram showing the semi-product of the heat sink is removing from the die.

Please refer to FIG. 7, which is a schematic diagram showing the semi-product of the heat sink 4 removed from the die 3. Due to the dove-tale shaped grooves 3111 of the pushing head 311, the semi-product of the heat sink 4 will be un-separated with (i.e., connected to) the force die part 31 while the force die part 31 is moving upward. When the force die part 31 is rising up, the semi-product of the heat sink 4 will be brought up as well. The worker can remove the semi-product of the heat sink 4 from the die 3 along the horizontal direction of the dove-tail shaped grooves 3111 of the pushing head 311.

Figure 8B:
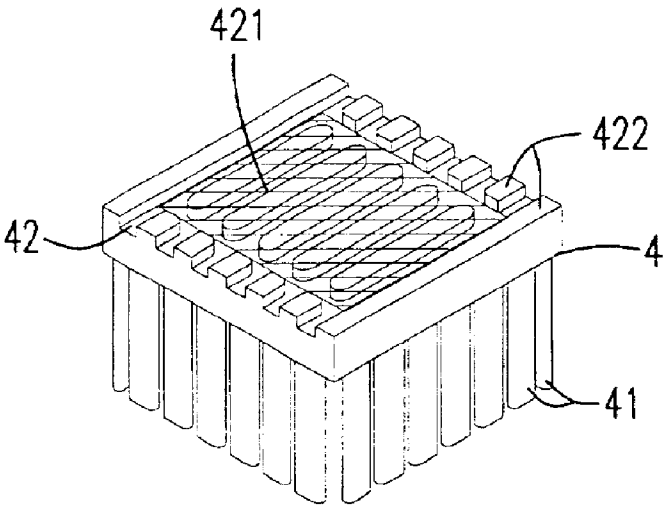
FIG. 8(*a*) and FIG. 8(*b*) are schematic diagrams showing the semi-products of the heat sink.
Figure 8A:
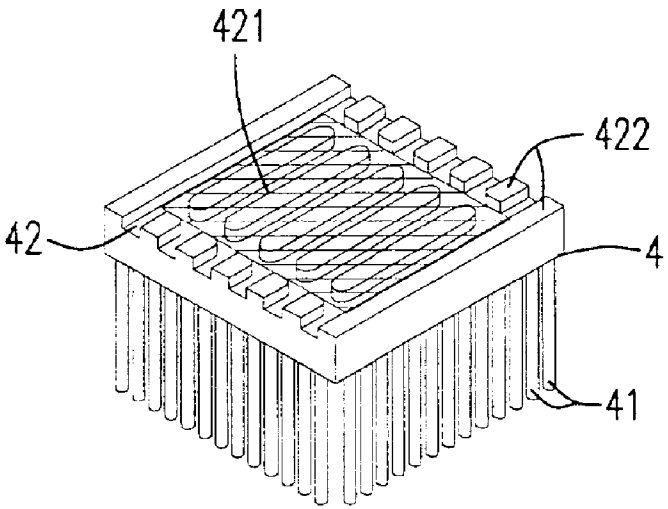

Please refer to FIGS. 8(*a*) and 8(*b*), which are schematic diagrams showing the semi-products of the heat sinks 4 in various shapes with radiation fins 41. The heat transfer promoting material 2 will form the central part 421 of the top surface 42 of the semi-product of the heat sink 4, and the main material 1 will form the surrounding part 422 of the top surface 42 of the semi-product of the heat sink 4.

Figure 9B:
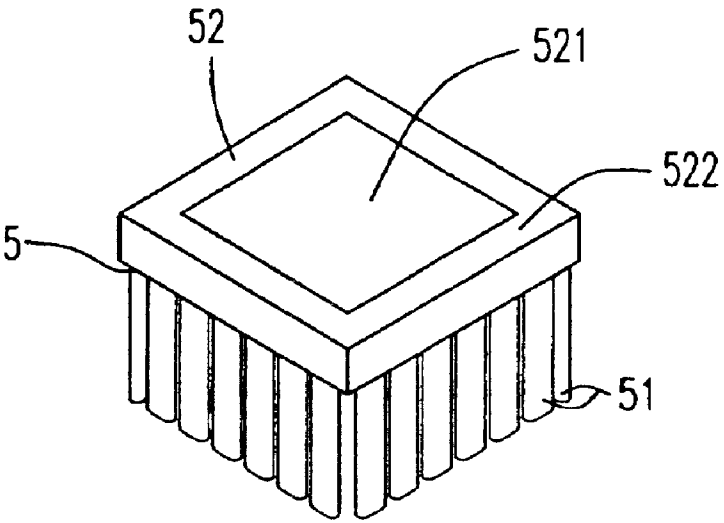
FIGS. 9(*a*) and 9(*b*) are schematic diagrams showing the final-products of the heat sink.
Figure 9A:
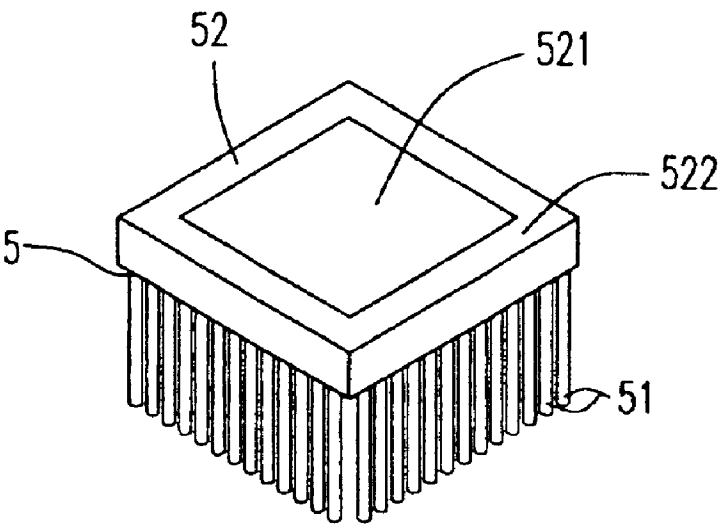

Please refer to FIGS. 9(*a*) and 9(*b*), which are schematic diagrams showing the final-products of the heat sink 5 in various shapes with radiation fins 51. These final-products of the heat sink 5 are produced from the semi-products of the heat sink 4 by the following steps: 1. cutting the top surface 42 of the semi-product of heat sink 4 into a base plate 52 of the heat sink 5; 2. grinding the base plate 52 of the heat sink 5. The heat transfer promoting material will form the central part 521 of the top surface 52 of the semi-product of the heat sink 5, and the main material will form the surrounding part 522 of the top surface 52 of the semi-product of the beat sink 5.

In conclusion, the present invention would effectively improve the drawbacks of the prior art regarding the environmental protection problems as well as saving the manufacturing costs and improving the quality of the heat sinks without plating and brazing processes. Thus, the present invention has its value in the industry, and the purpose of developing the present invention is achieved.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A method for manufacturing a heat sink, comprising the steps of:

(a) putting a main material with a top into a die;

(b) placing a heat transfer promoting material on said top of said main material, wherein said heat transfer promoting material has a thermal conductivity larger than that of said main material;

(c) overflowing a material of said main material to bind together with said heat transfer promoting material after being pushed under pressure;

(d) projecting a plurality of radiation fins of said heat sink from said main material through a plurality of holes of said die;

(e) causing said heat transfer promoting material to form a central part of a top surface of said heat sink and said main material to form a surrounding part of said top surface of said heat sink;

(f) removing said heat sink from said die; and (g) cutting and grinding said top surface of said heat sink into a base plate of said heat sink to form a said heat sink having a said plurality of radiation fins.

2. The method according to claim 1, wherein said main material has a plurality of positioners confining thereamong said heat transfer promoting material.

3. The method according to claim 2, wherein said positioners have a shape selected from a group consisting of walls, ribs, poles, pins, dowels, stops, and any combination thereof.

4. The method according to claim 2, wherein said positioners are part of said main material.

5. The method according to claim 2, wherein said heat transfer promoting material, said main material, and said positioners are manufactured into a desired shape by a process selected from a group consisting of pressing, extruding, die-casting, powder-forming, machining and any combination thereof.

6. The method according to claim 1, wherein said main material is larger than said heat transfer promoting material.

* * * * *